United States Patent [19]

Kleykamp et al.

[11] Patent Number: 4,602,568

[45] Date of Patent: Jul. 29, 1986

[54] HOLDDOWN BAR FOR A HATCH COVER OF A RAILROAD CAR

[75] Inventors: Donald L. Kleykamp, Dayton, Ohio; James B. Rush, Haywood County, N.C.

[73] Assignee: Dayco Corporation, Dayton, Ohio

[21] Appl. No.: 456,154

[22] Filed: Jan. 6, 1983

[51] Int. Cl.[4] ..... B61D 39/00

[52] U.S. Cl. ..... 105/377

[58] Field of Search ..... 16/86 A, 228, 273, 385, 16/386; 49/489, 490, 491, 492, 493; 52/45, 49, 51, 52, 55, 200, 309.16, 403, 471, 716, 717, 718; 248/500, 501; 285/112, 330, 425; 292/87, 241, 256.5, 256; 403/338; 220/314, 315; 105/377

[56] References Cited

U.S. PATENT DOCUMENTS

| | | | |
|---|---|---|---|
| 3,082,022 | 3/1963 | Moore | 285/330 X |
| 3,470,598 | 10/1969 | Berthelsen | 52/309.16 X |
| 3,645,573 | 2/1972 | Strang | 292/241 |
| 4,239,008 | 12/1980 | Conlon | 105/377 |
| 4,261,479 | 4/1981 | Caserta | 292/87 X |
| 4,270,668 | 6/1981 | Berfield | 292/87 X |
| 4,378,742 | 4/1983 | Saylor et al. | 292/256.5 |
| 4,440,814 | 4/1984 | Wolters | 52/716 X |

OTHER PUBLICATIONS

Admitted Prior Art to Applicants of Copending Patent Application, Ser. No. 412,416, filed Aug. 27, 1982—Clark et al.

*Primary Examiner*—Robert B. Reeves
*Assistant Examiner*—Dennis C. Rodgers
*Attorney, Agent, or Firm*—Joseph V. Tassone

[57] ABSTRACT

A holddown bar for a hatch cover of a railroad car or the like is provided, the holddown bar having opposed ends one of which has a hinge unit that is adapted to be pivotally mounted to the car and the other of which has a latch unit that is adapted to be releasably latched to the car while a medial portion thereof intermediate the opposed ends is adapted to extend across the hatch cover and carries a sealing gasket in a channel thereof that is adapted to engage against the hatch cover. The opposed ends and medial portion of the holddown bar comprise a one-piece member formed of a relatively rigid polymeric material and has a reinforcing unit therein. The reinforcing unit comprises a substantially rigid member disposed in the polymeric material and having opposed ends one of which comprises the hinge unit for the holddown bar and the other of which is disposed in at least part of the polymeric material that defines the latch unit of the holddown bar, the rigid member having a medial portion extending between the ends thereof and being disposed in the polymeric material that defines the medial portion of the holddown bar.

7 Claims, 24 Drawing Figures

HOLDDOWN BAR FOR A HATCH COVER OF A RAILROAD CAR

BACKGROUND OF THE INVENTION

1. Field of the Invention

This invention relates to an improved holddown bar for a hatch cover of a railroad car or the like.

2. Prior Art Statement

It is known to applicants to provide a holddown bar for a hatch cover of a railroad car or the like, the holddown bar having opposed ends one of which has a hinge part that is adapted to be pivotally mounted to the car and the other of which has a latch part that is adapted to be releasably latched to the car while a median portion thereof intermediate the opposed ends is adapted to extend across the hatch cover and carries a sealing gasket in a channel thereof that is adapted to engage against the hatch cover. For example, see FIGS. 1–5 of this application which illustrate such prior known arrangement wherein the holddown bar is formed of at least three separate metal parts that are subsequently secured together.

SUMMARY OF THE INVENTION

It is one feature of this invention to provide an improved holddown bar for a hatch cover of a railroad car or the like, the holddown bar being of the type disclosed and claimed in the copending patent application, Ser. No. 412,416, filed Aug. 27, 1982 and assigned to the same assignee to whom this application is also assigned.

In particular, it was found according to the teachings of this invention that a substantially rigid reinforcing member can be disposed in the polymeric material of a holddown bar of the type disclosed and claimed in the copending patent application Ser. No. 412,416, filed Aug. 27, 1982 to make the same sufficiently strong so that the polymeric material thereof can be a material that is more flexible and/or more wear resistant, etc. than the material utilized when the holddown bar is merely made of all polymeric material without utilizing the reinforcing member of this invention.

For example, one embodiment of this invention provides a holddown bar for a hatch cover of a railroad car or the like, the holddown bar having opposed ends one of which has a hinge that is adapted to be pivotally mounted to the car and the other of which has a latch that is adapted to be releasably latched to the car while a medial portion thereof intermediate the opposed ends is adapted to extend across the hatch cover and carries a sealing gasket in a channel thereof that is adapted to engage against the hatch cover. The opposed ends and medial portion of the holddown bar comprise a one-piece member formed of a relatively rigid polymeric material and having a reinforcing member therein. The holddown bar has substantially flat and parallel opposed spaced apart sides throughout substantially the entire length of the opposed ends and medial portion thereof. The reinforcing comprises a substantially rigid member disposed in the polymeric material and having opposed ends one of which comprises the hinge for the holddown bar and the other of which is disposed in at least part of the polymeric material that defines the latch of the holddown bar, the rigid member having a medial portion extending between the ends thereof and being disposed in the polymeric material that defines the medial portion of the holddown bar. One of the opposed ends of the reinforcing member comprises a tubular member having opposed ends that respectively interrupt the opposed sides of the holddown bar and are disposed substantially flush with the respective sides of the holddown bar, the medial portion and the other opposed end of the reinforcing member being disposed inboard of the opposed sides of the holddown bar and being completely covered by the polymeric material.

Accordingly, it is an object of this invention to provide an improved holddown bar for a hatch cover of a railroad car or the like, the holddown bar of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
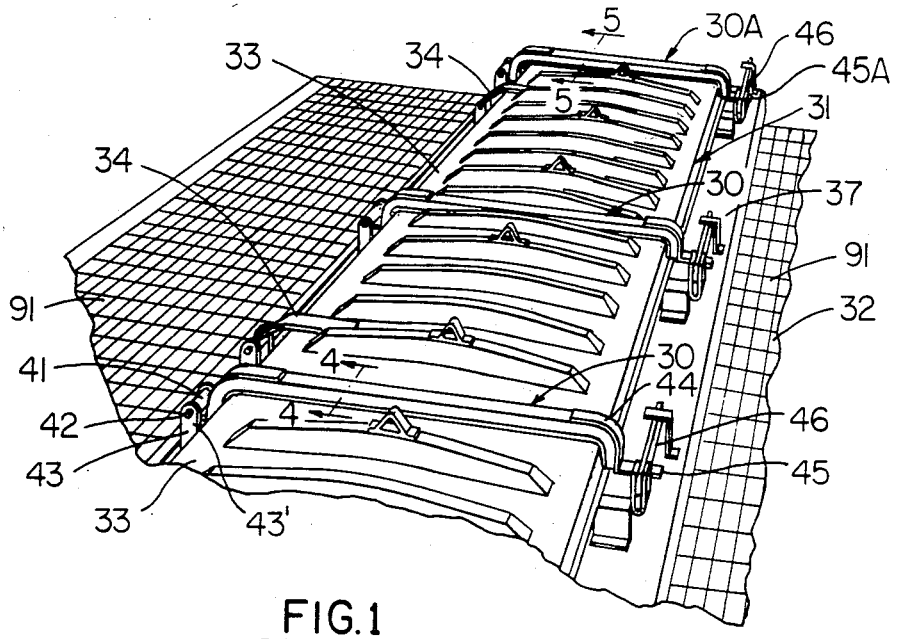
FIG. 1 PRIOR ART
FIG. 1 is a fragmentary top perspective view of a railroad car having holddown bars for the hatch covers thereof, FIG. 1 illustrating prior art holddown bars.

While the various features of this invention are hereinafter illustrated and described as providing a holddown bar for a certain type of hatch cover of a railroad car, it is to be understood that the various features of this invention can be used singly or in any combination thereof to provide a holddown bar for other structures as desired.

Therefore, this invention is not to be limited to only the embodiments illustrated in the drawings, because the drawings are merely utilized to illustrate one of the wide variety of uses of this invention.

It is believed that in order to fully describe the various features of this invention, a detailed disclosure of the prior art structure should be first set forth.

Figure 2:
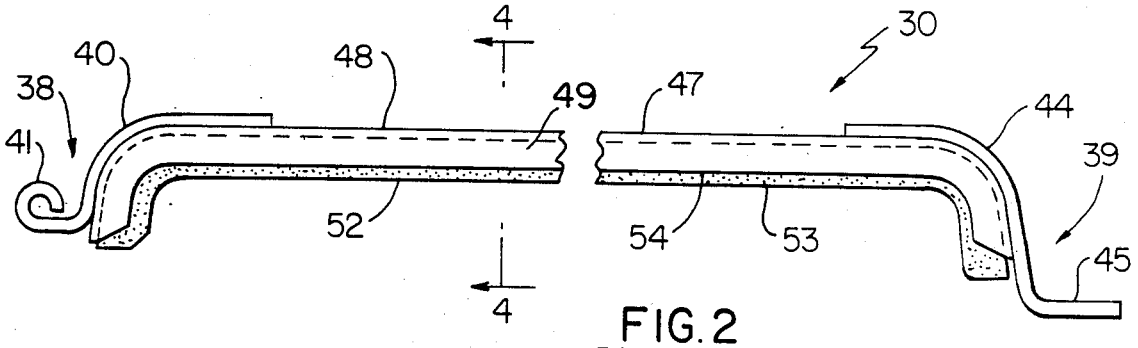
FIG. 2 PRIOR ART
FIG. 2 is an enlarged side view of one of the prior art holddown bars of FIG. 1.
Figure 3:
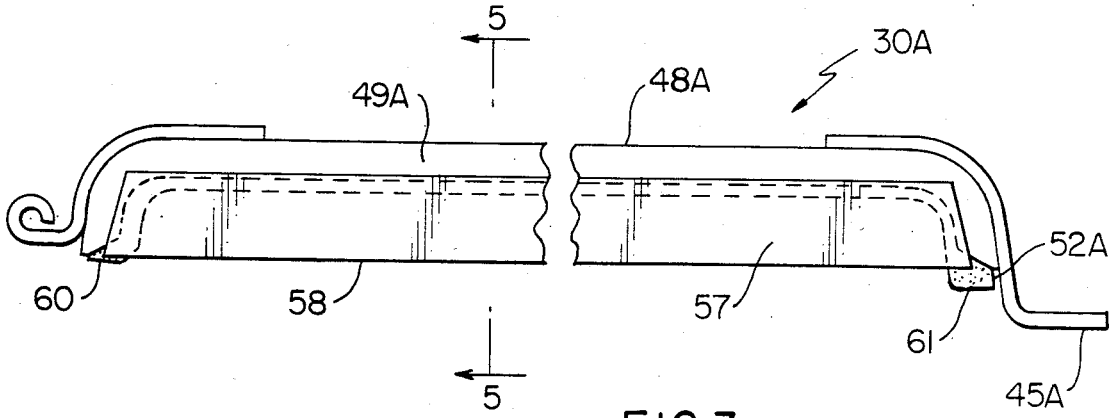
FIG. 3 PRIOR ART
FIG. 3 is an enlarged side view of another of the prior art holddown bars of FIG. 1.
Figure 4:
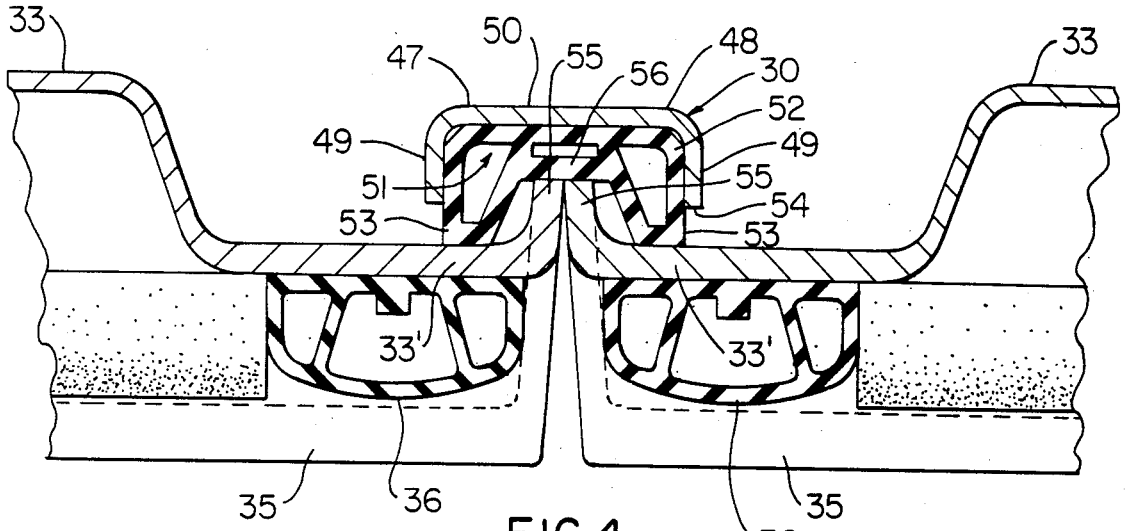
FIG.4 PRIOR ART
FIG. 4 is an enlarged fragmentary cross-sectional view taken on line 4—4 of FIG. 2 as well as on line 4—4 of FIG. 1.
Figure 5:
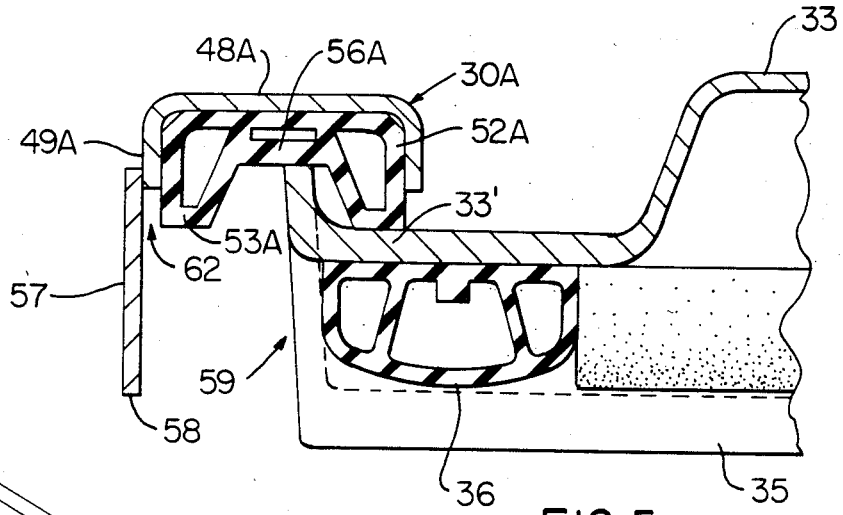
FIG.5 PRIOR ART
FIG. 5 is an enlarged fragmentary cross-sectional view taken on line 5—5 of FIG. 3 as well as on line 5—5 of FIG. 1.

Accordingly, referring now to FIGS. 1–5, one prior known holddown bar for a hatch cover of a railroad car is generally indicated by the reference numeral 30 in FIGS. 1, 2 and 4 while another prior known holddown bar is generally indicated by the reference numeral 30A in FIGS. 1, 3 and 5, the prior known holddown bars 30 and 30A being illustrated in FIG. 1 as holding closed the hatch cover unit 31 of a conventional railroad car 32.

The hatch cover unit 31 of the railroad car 32 comprises two like hatch covers 33 disposed in aligned relation and each being pivotally mounted to the car 32 by hinges 34 in a manner conventional in the art.

Each hatch cover 33 has a peripheral flange 35 carrying sealing gaskets 36 which are adapted to be disposed in sealing relation against the hatch opening flange 37 and be held in sealing engagement therewith by the holddown bars 30 and 30A in a manner well known in the art to fully close the hatch opening (not shown) in the top of the railroad car 32.

The prior known holddown bar 30 has opposed ends 38 and 39 with the end comprising a metal plate 40 that is formed to define a tubular part 41 that is adapted to be pivotally mounted to a pivot pin 42 of a bracket 43 carried by the railroad car 32 in a manner well known in the art whereby the holddown bars 30 are adapted to pivot on the pivot pins 42 and between the upstanding side flanges 43' of the brackets 43.

Each prior known holddown bar 30 has the other end 39 thereof formed from a metal plate 44 so shaped that the same defines a toe or latch plate 45 which is adapted to be releasably latched to the car 32 by a suitable latch member 46 extending over the same as illustrated in FIG. 1 in a manner well known in the art whereby a medial portion 47 of the holddown bar 30 will extend across the respective hatch cover 33 or covers 33 to sealingly engage thereagainst and hold the respective hatch cover 33 or covers 33 in sealing relation against the hatch opening flange 37 of the railroad car 32 in a manner well known in the art.

The medial portion 47 of each holddown bar 30 comprises a metal channel member 48 having a pair of spaced parallel legs 49 and a cross member 50 that define a channel 51 which receives a resilient sealing gasket 52 therein which has side portions 53 that extend outboard of the bottom edges 54 of the legs 49 of the U-shaped channel member 48 as illustrated in FIGS. 2 and 4 so as to sealingly engage directly against the hatch cover 33 or covers 33. For example, FIG. 4 illustrates the holddown bar 30 spanning and engaging the adjacent upstanding end flanges 55 at the adjacent ends 33' of the hatch covers 33 with a central section 56 of the gasket 52 while the side portions 53 of the gasket 52 sealingly engage against the respective covers 33 inboard of the flanges 55 thereof as illustrated in FIG. 4. In this manner, not only are the adjacent ends 33' of the two hatch covers 33 held in a sealing closed condition against the hatch opening flange 37 by the holddown bar 30 of FIG. 4, but also the gasket 52 of the holddown bar 30 seals the adjacent flanges 55 to each other.

As illustrated in FIG. 1, at least one other holddown bar 30 is provided on the railroad car 32 for each hatch cover 33 and is disposed intermediate the opposed ends 33' of the respective hatch cover 33 to engage against such hatch cover 33 and hold the same in its closed condition against the hatch opening flange 37.

The metal end plates 40 and 44 that define the opposed ends 38 and 39 of each holddown bar 30 are secured to the metal channel member 48, such as by welding or the like, and the sealing gasket 52, which is formed of rubber or the like, is secured in the channel 51 of the channel member 48 by a suitable adhesive or the like. The surfaces of the metal parts of the holddown bar can be provided with protective coatings or the like.

Each holddown bar 30A is formed in substantially the same manner as the holddown bar 30 previously described whereby like parts are indicated by like reference numerals followed by the reference letter "A".

As illustrated in FIGS. 3 and 5, each holddown bar 30A is formed identical to the holddown bar 30 previously described except that the same has a metal side plate 57 welded to the particular leg 49A of the channel member 48A so as to have its lower edge 58 extend closely adjacent the hatch flange 37 of the car 32 as illustrated in FIG. 5 so as to tend to protect the particular end 33' of the hatch cover 33 that is exposed to the elements at each end of the railroad car 32 in the area of the reference numeral 59 in FIG. 5 whereby the two end holddown bars 30A for each railroad car 32 have the side plates 57 on different legs 49A of their respective channel member 48A.

However, it was found according to the teachings of the invention set forth in the copending patent application, Ser. No. 412,416, filed Aug. 27, 1982, that not only are the opposed ends 60 and 61 of the gasket 52A of each holddown bar 30A exposed to the elements as illustrated in FIG. 3 even though the side plate 57 is being utilized, but also the sealing gasket 52A of each holddown bar 30A as illustrated in FIG. 5 has an area in the region of the reference numeral 62 subjected to wind, ice, snow, etc. which tend to start gasket tear and, thus, early wear out of the sealing gasket 52A. In addition, it is believed that the sharp metal edges on the U-shaped channel member 48A tend to cause cutting of the gasket 52A and, thus, also early wear out thereof.

It can readily be seen from FIG. 1 that the hatch covers 33 are adapted to be latched in the closed position by the holddown bars 30 and 30A having the latch toes 45 and 45A thereof held in the latched position by the latches 46 whereby the sealing gaskets 36 of the covers 33 are held in sealing relation against the hatch opening flange 37 until it is desired to open the hatch covers 33.

In particular, in order to open a particular hatch cover 33, the latches 46 for the holddown bars 30 and 30A for that particular hatch cover 33 are opened so that the holddown bars 30 and 30A can be pivoted on their pivot ends 38 at the brackets 43 in a manner to be out of the way of the particular hatch cover 33 so that that particular hatch cover 33 can be opened on its hinge structure 34 in a manner conventional in the art.

Figure 6:
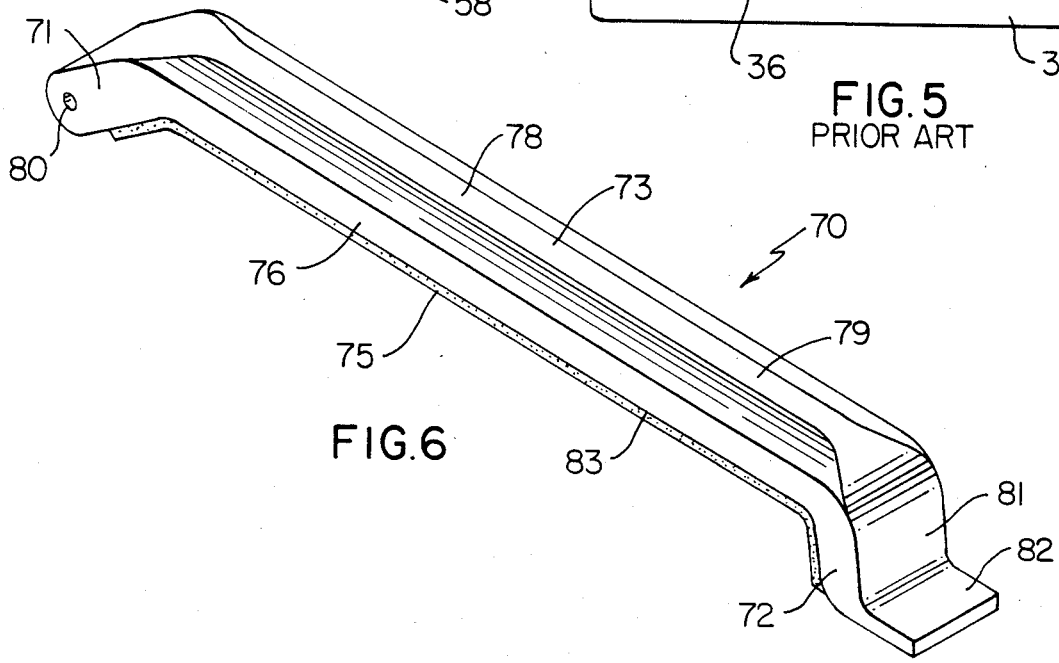
FIG. 6 is a top perspective view of one of the improved prior known holddown bars of the invention of the copending patent application, Ser. No. 412,416, filed Aug. 27, 1982.

As previously stated, it was found according to the teachings of the invention set forth in the copending patent application, Ser. No. 412,416, filed Aug. 27, 1982, that the prior known substantially all metal holddown bars 30 and 30A can be replaced by the uniquely formed holddown bars of that invention that are generally indicated by the reference numeral 70 in FIG. 6 and 70A in FIG. 11, the holddown bars 70 of FIG. 6 to replace the intermediate holddown bars 30 of FIG. 1 and the holddown bars 70A of FIG. 11 to replace the holddown bars 30A of FIG. 1 as will be apparent hereinafter whereby this copending patent application, Ser. No. 412,416, filed Aug. 27, 1982 is being incorporated into this disclosure by this reference thereto. However, sufficient details of the holddown bars of such copending application will now be described in this application in order to fully understand the improved features of this invention.

In particular, the holddown bars 70 and 70A respectively have opposed ends 71, 72 and 71A, 72A integrally and respectively interconnected together by medial portions 73 and 73A, the medial portions 73 and 73A, as well as at least part of the respective opposed ends 71, 72 and 71A, 72A, being so constructed that the same define channels 74 and 74A therein that receive the resilient sealing gaskets 75 and 75A which are disposed between pairs of spaced apart substantially parallel legs 76 and 76A.

The holddown bars 70 and 70A are made from a relatively rigid polymeric material and are formed, such as by molding, so that the opposed ends 71, 72 and 71A, 72A, as well as the medial portions 73 and 73A thereof, respectively comprise one-piece members that form the unique configurations illustrated in the drawings.

In particular, the medial portions 73 and 73A of the holddown bars 70 and 70A are substantially straight with the top portions 78 and 78A thereof each having a substantially trapezoidal cross-sectional configuration so as to provide substantially streamlined top surfaces 79 and 79A of the respective holddown bars 70 and 70A, as well as added strength to the medial portions 73 and 73A thereof.

Figure 8:
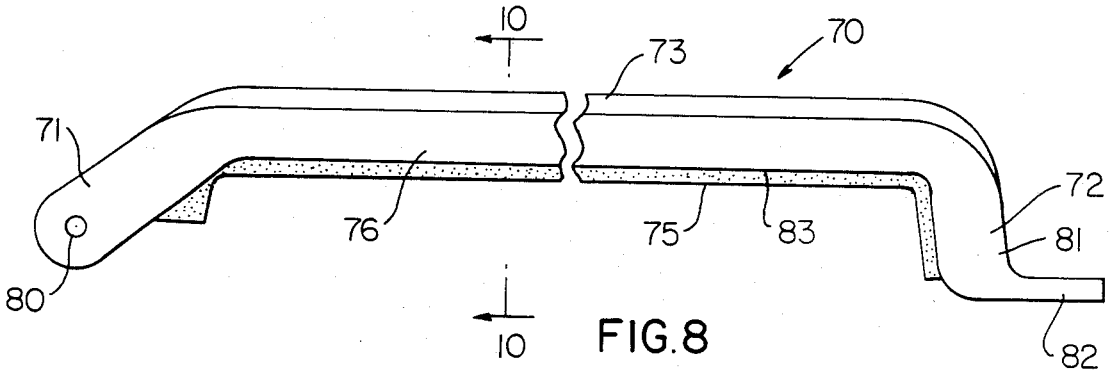
FIG. 8 is a side view of the holddown bar of FIG. 7.
Figure 9:
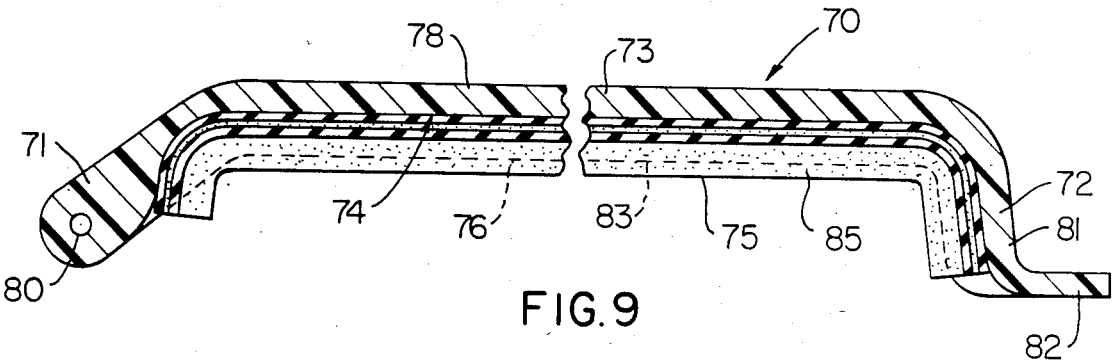
FIG. 9 is a cross-sectional view taken on line 9—9 of FIG. 7.
Figure 11:
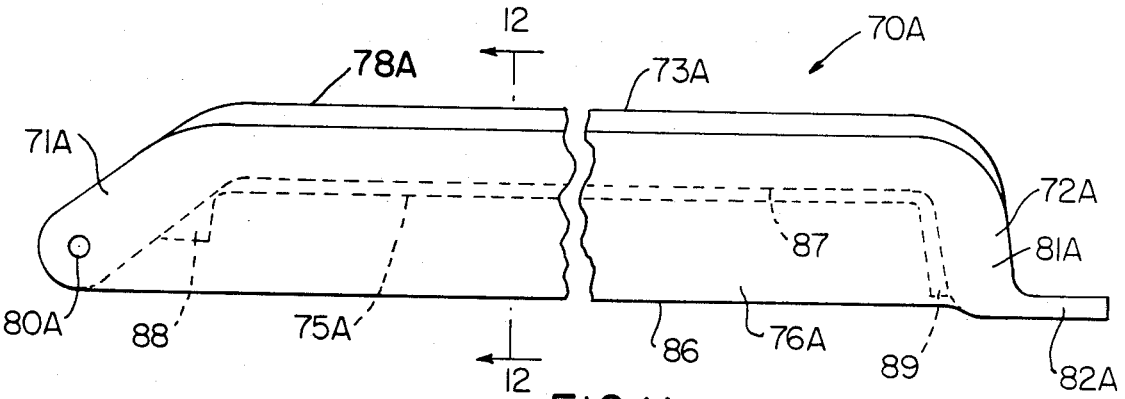
FIG. 11 is a side view of another improved prior known holddown bar of the invention of the aforementioned copending patent application.

The ends 71 and 71A of the respective holddown bars 70 and 70A are substantially straight and are respectively disposed at obtuse angles relative to the respective medial portions 73 and 73A as illustrated respectively in FIGS. 8 and 11.

In this manner, the ends 71 and 71A of the holddown bars 70 and 70A respectively have the same width as the pair of legs 76 and 76A as well as provide relatively large masses of material to have the respective pivot holes 80 and 80A passing therethrough for respectively receiving the pivot pins 42 of the brackets 43 of the railroad car 32 when the same are utilized to replace the holddown bars 30 and 30A as previously described.

Figure 7:
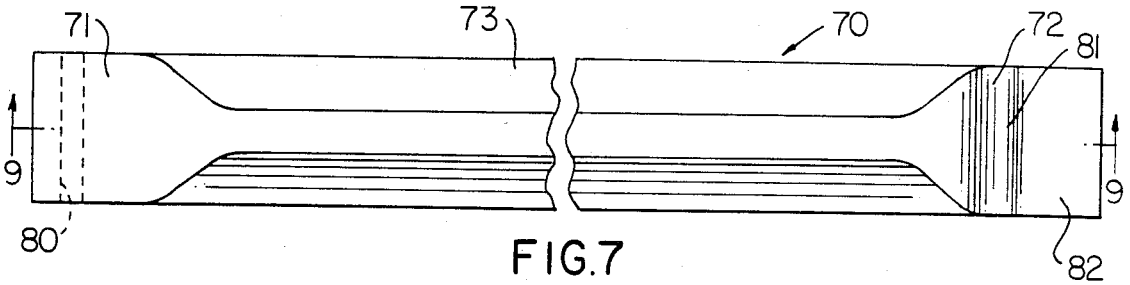
FIG. 7 is a top view of the holddown bar of FIG. 6.

The other ends 72 and 72A of the respective holddown bars 70 and 70A are substantially L-shaped and are defined by a pair of legs 81, 82 and 81A, 82A that join each other substantially at a right angle while the legs 81 and 81A respectively join the medial portions 73 and 73A substantially at right angles as illustrated respectively in FIGS. 8 and 11. The ends 72 and 72A are substantially the same width as the ends 71 and 71A previously described whereby the overall top view configurations of the holddown bars 70 and 70A of this invention are substantially rectangular as illustrated in FIG. 7.

Figure 10:
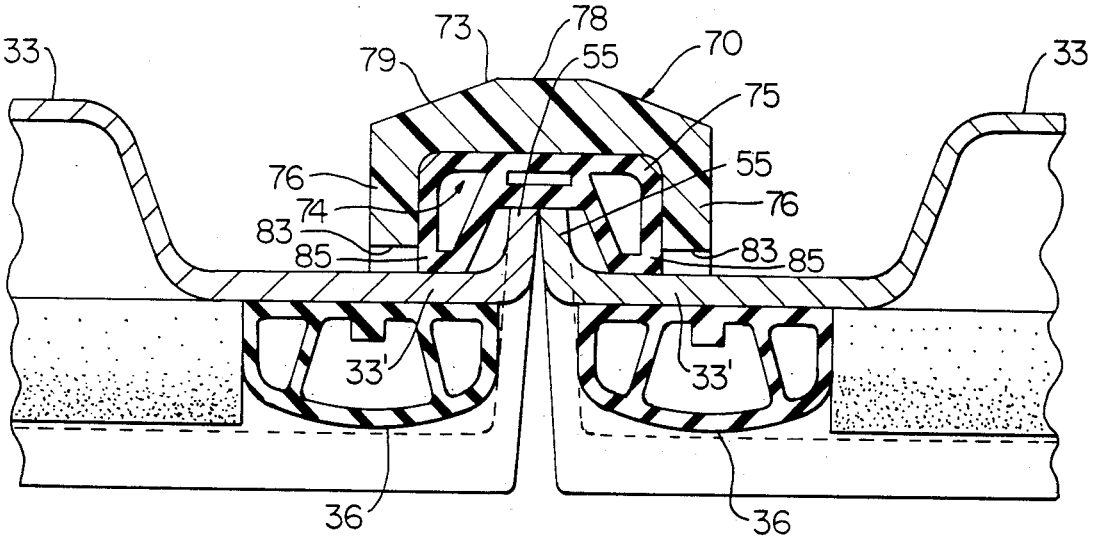
FIG. 10 is an enlarged fragmentary cross-sectional view taken on 10—10 of FIG. 8 and illustrates the holddown bar in combination with hatch covers in a manner similar to FIG. 4.
Figure 12:
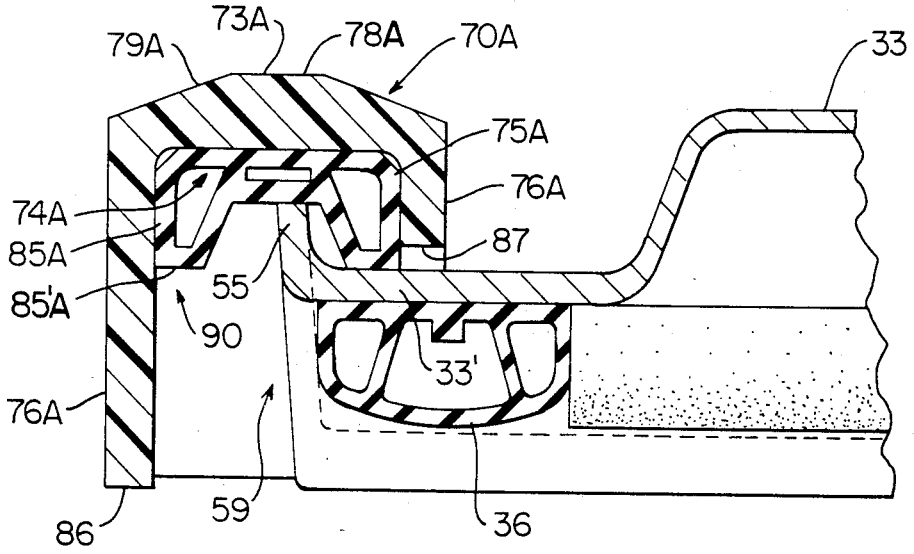
FIG. 12 is an enlarged fragmentary cross-sectional view taken on line 12—12 of FIG. 11 and illustrates the holddown bar in combination with a hatch cover in a manner similar to FIG. 5.

As illustrated in FIG. 10, the legs 76 of the holddown bar 70 respectively have bottom edges 83 which are disposed substantially coplanar with each other while the side portions 85 of the gasket 75 extend outboard of the end edges 83 whereas in contrast the bottom edges 86 and 87 of the legs 76A of the holddown bar 70A are disposed in offset relation so that the bottom edge 86 of the longer leg 76A will extend closely adjacent the hatch opening flange 37 of the railroad car 32 as illustrated in FIG. 12 to protect the end area 59 of the adjacent end 33' of the hatch cover 33 in a believed to be more effective manner than the side plate 57 of the holddown bar 30A previously described.

In particular, it can readily be seen in FIG. 11 that the longer leg 76A has its bottom edge 86 disposed so that the same fully protects the opposed end portions 88 and 89 of the gasket 75A whereas it can readily be seen in FIG. 3 that the opposed ends 60 and 61 of the gasket 52A are exposed to the elements below the bottom edge 58 of the side plate 57 thereof.

In addition, it can readily be seen in FIG. 12 that the longer leg 76A of the holddown bar 70A is fully disposed against the sealing gasket 75A all the way to the bottom edge 85'A of the adjacent portion 85A thereof so that wind, dirt, sleet, etc. cannot enter between the longer leg 76A and the gasket means 75A in the region of the reference numeral 90 whereas in contrast it can readily be seen in FIG. 5 that wind, dirt, sleet, etc. can enter into the region indicated by the reference numeral 62 to attack the lower free end 53A of the sealing gasket 52A to begin a tear area therein as previously described.

As previously stated, the holddown bars 70 and 70A can be formed from any suitable relatively rigid polymeric material that can be molded into the configurations illustrated and the gaskets 75 and 75A can be subsequently and respectively adhesively secured in the channels 74 and 74A to perform a sealing function with the flanges 55 of the hatch covers 33 as well as against points thereon inboard of the flanges 55 as illustrated respectively in FIGS. 10 and 12.

For example, the relatively rigid polymeric material for forming the holddown bars 70 and 70A can be an ultra high molecular weight synthetic plastic material, such as nylon, polyethylene, urethane, etc., having a molecular weight of between two million and six million. For example, such an ultra high molecular weight polyethylene material and a method of molding the same is disclosed in the U.S. Pat. No. 4,238,039 to Cooper et al, whereby this patent is being incorporated into this disclosure by this reference thereto. Also, such polymeric material for the holddown bars 70 and 70A could be reinforced, such as is disclosed in this patent to Cooper et al or as hereinafter set forth in accordance with the teachings of this invention.

Accordingly, it can be seen that it is a relatively simple method to form the holddown bars 70 and 70A, such as by a simple molding operation, so that the same are substantially one-piece members that readily replace the holddown bars 30 and 30A of the railroad car 32 illustrated in FIG. 1 as the ends 71 and 71A thereof readily permit the same to be pivotally mounted on the pivot pins 42 of the brackets 43 and the legs 82 and 82A of the ends 72 and 72A readily accept the latches 46 to permit latching of the holddown bars 70 and 70A with their medial portions 73 and 73A extending across the hatch covers 33 in such a manner that the sealing gaskets 75 and 75A thereof will seal and hold against the hatch covers 33 so that their respective sealing gaskets 36 will readily seal against the hatch opening flange 37 in the manner previously described.

However, it has been found that the holddown bars 70 and 70A are approximately sixty percent lighter than their steel counterparts 30 and 30A whereby a weight advantage of approximately 35 pounds per railroad car 32 is provided when the holddown bars 70 and 70A are substituted for the holddown bars 30 and 30A and such railroad car 32 had two holddown bars 30A and three holddown bars 30.

It is also believed that the holddown bars 70 and 70A are four times more wear resistant than the stainless steel counterpart holddown bars 30 and 30A.

Since the holddown bars 70 and 70A have less weight than their steel counterparts 30 and 30A, it is believed that the holddown bars 70 and 70A will not overload their respective gaskets 75 and 75A, as well as the gaskets 36 of the hatch covers 33, so as to permit the gaskets to maintain their sealing resilience for a longer period of time.

In addition to the chemical resistance and no-rust properties of the polymeric material of the holddown bars 70 and 70A, the polymeric material thereof is compatible with the plastic material that normally forms the hatch covers 33. This is particularly important because it has been found that as railroad cars 32 vibrate, twist and torque, the weight and pressure of a steel holddown bar, with its alien physical properties, can cause undue wear and cracks in the hatch covers 33. Since hatch cover replacements are costly, it is believed that by utilizing the holddown bars 70 and 70A, since the same have substantially the same expansion, contraction and mechanical characteristics as the hatch covers 33, a major source of stress and wear on the hatch covers 33 will be eliminated.

Since the operation of the holddown bars 70 and 70A are substantially the same as the holddown bars 30 and 30A previously described, it is deemed unnecessary to further describe the operation of the holddown bars 70 and 70A except to state that same can readily replace the holddown bars 30 and 30A.

When the holddown bars 70 and 70A are formed of the aforementioned ultra high molecular weight nylon, and such material was presently the preferred material for the holddown bars 70 and 70A, such material will provide the following characteristics among others: high tensile strength for structural rigidity; maintains its strength over a wide temperature range; heat distortion only occurs at temperatures over 400° F.; has outstanding wear resistance; is approximately seven times lighter than most metals; has excellent chemical resistance; has self-extinguishing flamability characteristics; is ultraviolet resistant; is self-lubricating, such as in the hinge area that is indicated by the reference numerals 42, 43 in FIG. 1; does not rust; and provides no damage to the running boards of the railroad car 32 which are indicated by the reference numeral 91 in FIG. 1.

While the holddown bars of the invention of the aforementioned copending patent application have been illustrated and described as being substantially homogeneous throughout the entire structure thereof, except for the sealing gasket thereof, the holddown bars of that invention are described as being adapted to be provided with reinforcing inserts as desired, such as in substantially the same manner as the reinforcing inserts disposed in the plastic material referred to in the aforementioned U.S. Pat. No. 4,238,039.

Figure 13:
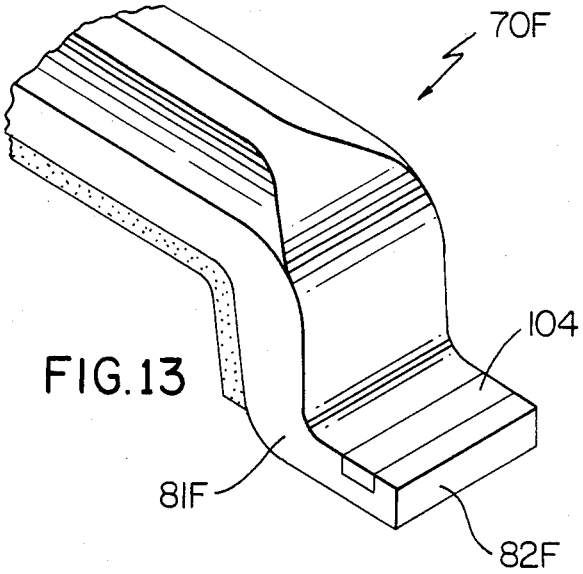
FIG. 13 is a fragmentary perspective view of another improved prior known holddown bar of the invention of the aforementioned copending patent application.

For example, reference is made to FIG. 13 wherein another holddown bar of that invention is generally indicated by the reference numeral 70F and has a metal insert 104 embedded in the leg 82F of the latching end 81F thereof so as to take the full impact of the latch means 46 of the railroad car 32 previously described.

Figure 14:
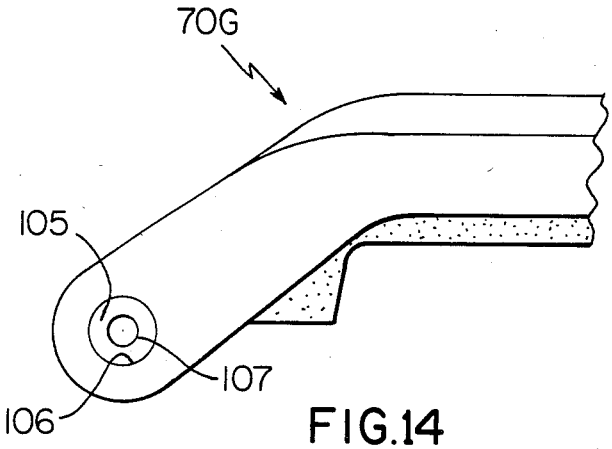
FIG. 14 is a fragmentary side view of another improved prior known holddown bar of the invention of the aforementioned copending patent application.

In this same vein, the hinged end of the holddown bars of that invention is described as being adapted to be reinforced. For example, reference is made to FIG. 14 wherein another holddown bar of that invention is generally indicated by the reference numeral 70G and the same has a tubular bushing 105 formed of metal or any other suitable material disposed in an opening 106 passing therethrough, the bushing 105 itself having an opening 107 passing therethrough for receiving the pivot pin 42 of a particular hinge bracket 43 of the railroad car 32 for the reasons previously set forth whereby the bushing 105 will provide a greater wear resistance to the galling action of the pivot pin 42.

Therefore, it can be seen that each of the holddown bars of the aforementioned copending patent application can comprise a one-piece member formed of relatively rigid polymeric material and having a reinforcing member therein.

As previously stated, it is a feature of this invention to provide an improved holddown bar of the type set forth in the aforementioned copending patent application wherein the same has an improved reinforcing member as provided by the teachings of this invention.

Figure 15:
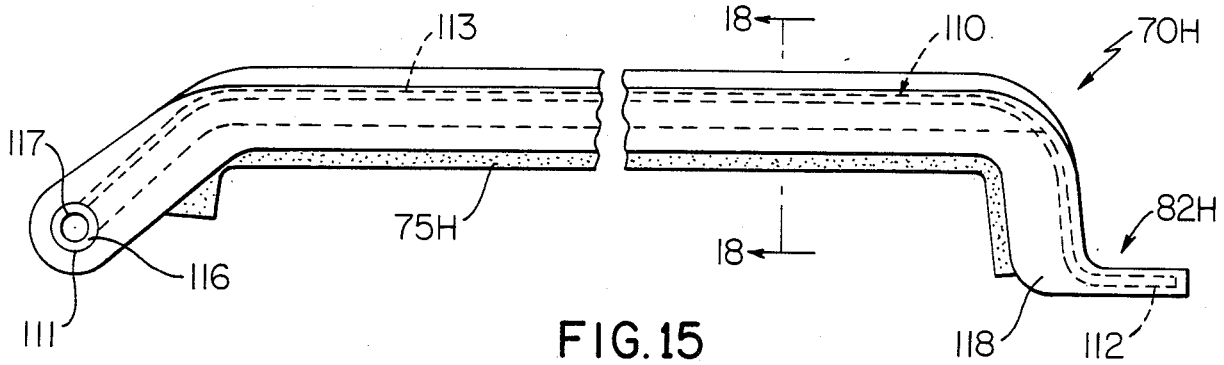
FIG. 15 is a side view of the improved holddown bar of this invention.
Figure 16:
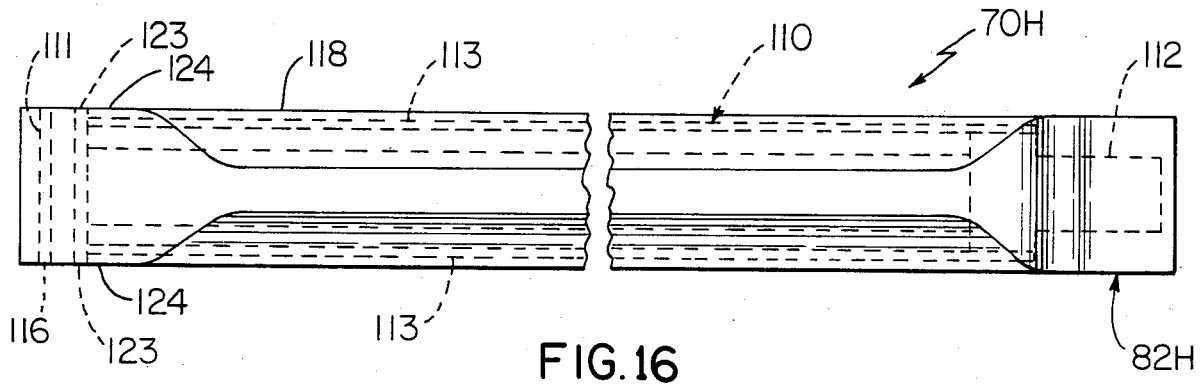
FIG. 16 is a top view of the holddown bar of FIG. 15.
Figure 18:
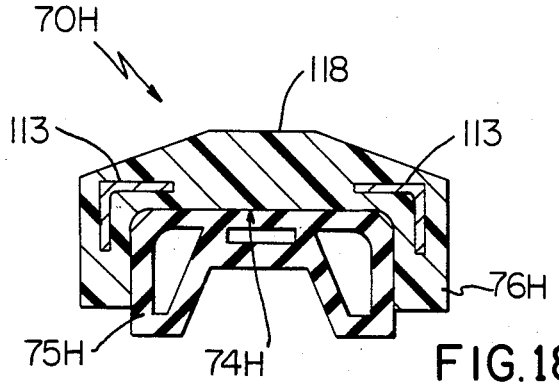
FIG. 18 is an enlarged cross-sectional view taken on line 18—18 of FIG. 15.

Accordingly, reference is now made to FIGS. 15, 16 and 18 wherein such an improved holddown bar of this invention is generally indicated by the reference numeral 70H and parts thereof similar to the holddown bars 70, 70A, 70F and 70G previously described are indicated by like reference numerals followed by the reference letter "H".

Figure 17:
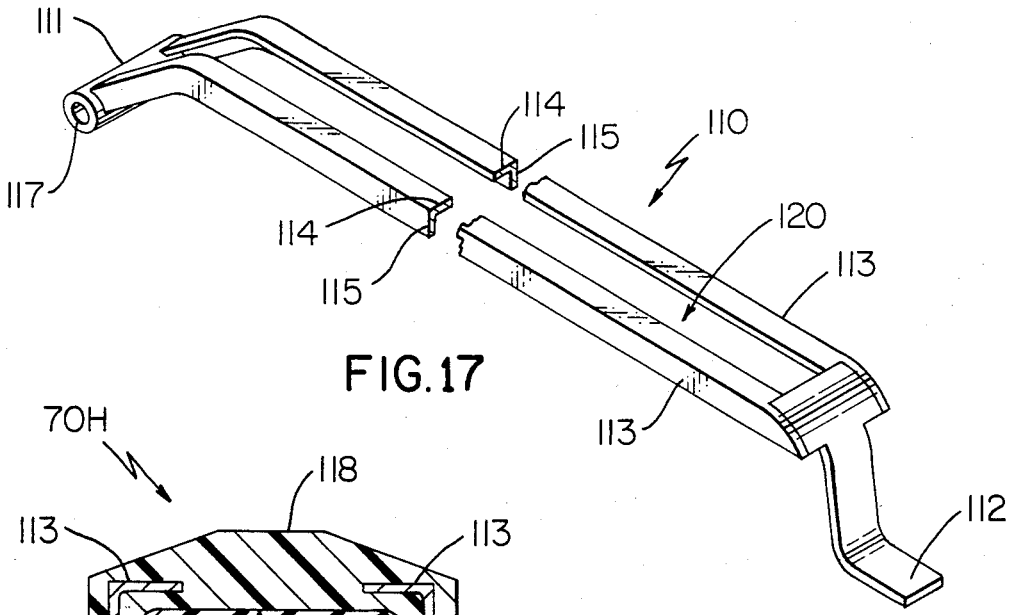
FIG. 17 is a perspective view of the reinforcing member of this invention that is utilized in the holddown bar of FIGS. 15 and 16.

As illustrated in FIGS. 15–18, it can be seen that the holddown bar 70H of this invention is substantially the same as the holddown bar 70 previously described except that the holddown bar 70H of this invention has an improved rigid member therein that is generally indicated by the reference numeral 110 in FIG. 17 and comprises a substantially tubular section 111 and a substantially flat plate-like section 112 with the sections 111 and 112 being opposed ends of the member 110 and being interconnected together by a pair of beam-like sections 113 each having a substantially L-shaped transverse cross section defined by a pair of legs 114 and 115.

While the reinforcing 110 can be formed of any suitable rigid material, such as steel, aluminum, polymeric material etc., the reinforcing 110 is illustrated as being formed of metallic material wherein the plate-like section 112 is formed separately and subsequently secured to the beam-like sections 113 such as by welding or the like. Similarly, the tubular section 111 is formed separately and subsequently welded to the beam-like sections 113.

In this manner, the tubular section 111 can be formed of a different material than the beam-like members 113, if desired, as the same defines the hinge-like portion 116 of the holddown bar 70H of this invention, the tubular section 111 having an opening 117 passing therethrough and is either formed of a material that forms an anti-friction part for the pivot pin 42 of the hinge 43 of the railroad car 32 or is subsequently suitably lined with such anti-friction material as desired.

In any event, it can be seen that the reinforcing member 110 of this invention is adapted to be completely embedded in the polymeric material of the holddown bar 70H to reinforce the same, the polymeric material of the holddown bar 70H being generally indicated by the reference numeral 118.

In particular, it can be seen that the rigid reinforcing member 110 of this invention has the opposed ends 111 and 112 thereof disposed in the polymeric material 118 in such a manner that the tubular end 111 of the reinforcing member 110 defines the hinge 116 for the holddown bar 70H while the plate-like portion or end 112 of the reinforcing member 110 is disposed in at least part of the polymeric material 118 that defines the latching end 82H of the holddown member 70H to reinforce the same for the purpose previously set forth, the medial portion or beam-like parts 113 of the rigid member 110 being completely disposed in the medial portion 73H of the polymeric material 118 of the holddown bar 70H as illustrated.

The polymeric material 118 of the holddown bar 70H of this invention has the cavity 74H formed therein for reinforcing the sealing gasket 75H and is so located that the part 119 of the cavity 74H is disposed intermediate and inboard of the legs 115 of the beam-like sections 113 of the reinforcing member 110 as fully illustrated in FIG. 18 whereby the legs 115 of the beam-like sections reinforce the legs 76H of the holddown bar 70H as illustrated in FIG. 18.

In this manner, the unique rigid reinforcing member 110 of this invention permits the polymeric material 118 that forms the holddown bar 70H of this invention to be a more flexible and/or wear-resistant polymeric material than the polymeric material that is utilized when the reinforcing member 110 of this invention is not being utilized.

Since it can readily be seen that the holddown bar 70H of this invention performs its function in the same manner as the holddown bar 70 previously described, a discussion of the operation of the holddown bar 70H of this invention will not be set forth.

Nevertheless, it can be seen that it is relatively a simple method of this invention to form the holddown bar 70H of this invention by merely causing the polymeric material 118 to be molded around the rigid reinforcing member 110 of this invention so that not only does the reinforcing member 110 provide strength to the polymeric material 118 and the hinge 116 therefor, but also the polymeric material 118 is mechanically interlocked to the rigid member 110 by being disposed completely around the same and also by filling the resulting slot or opening 120 defined between the adjacent legs 114 of the beam-like sections 113 as illustrated in FIG. 17.

While the holddown bar 70H of this invention as previously described is utilized to replace the holddown bars 70 previously described for extending across the hatch covers 33 intermediate the opposed ends thereof or where the opposed ends are disposed adjacent each other in the manner previously described for the holddown bars 30 illustrated in FIG. 1, it is to be understood that the reinforcing member 110 of this invention can be utilized with an end holddown bar similar to the holddown bar 70A previously described.

Figure 19:
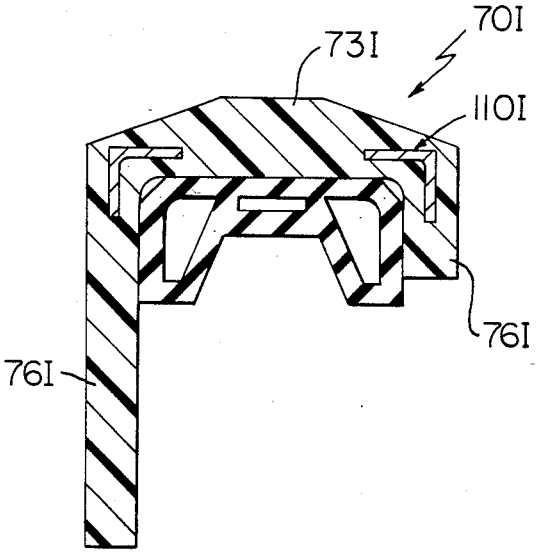
FIG. 19 is a view similar to FIG. 18 and illustrates another improved holddown bar of this invention.

For example, reference is now made to FIG. 19 wherein another holddown bar of this invention is generally indicated by the reference numeral 70I and parts thereof similar to the holddown bar 70H are indicated by like reference numerals followed by the reference letter "I".

As illustrated in FIG. 19, it can be seen that the medial portion 73I of the holddown bar 70I has different length legs 76I so that the left-hand leg 76I illustrated in FIG. 19 will perform the same function as the longer leg 76A of the holddown members 70A previously described, the holddown bar 70I of this invention having the reinforcing member 110I disposed therein in the same manner as the member 110 of the holddown bar 70H previously described.

However, it is to be understood that the leg 115 of the reinforcing member 110 of this invention of the particular beam-like section 113 thereof that is disposed in the longer leg 76I of the holddown member 70I could be utilized to reinforce substantially the entire length of the longer leg 76I if desired.

Figure 20:
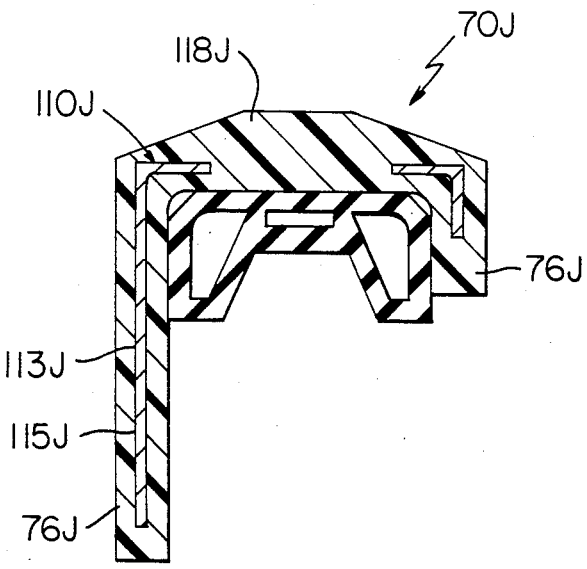
FIG. 20 is a view similar to FIG. 19 and illustrates another improved holddown bar of this invention.

For example, reference is now made to FIG. 20 wherein another holddown bar of this invention is generally indicated by the reference numeral 70J and parts thereof similar to the holddown bars 70H and 70I of this invention are indicated by like reference numerals followed by the reference letter "J".

As illustrated in FIG. 20, it can be seen that the holddown bar 70J is substantially identical to the holddown bar 70I previously described except that the left-hand beam-like section 113J of the reinforcing member 110J of this invention has the leg 115J thereof extending throughout substantially the entire length of the left-hand leg 76J of the polymeric material 118J of the holddown bar 70J to reinforce the longer leg 70J which is utilized for the purpose previously set forth.

While one form of rigid reinforcing member 110 of this invention has been previously set forth, it is to be understood that the reinforcing member of this invention can take other shapes as desired.

Figure 21:
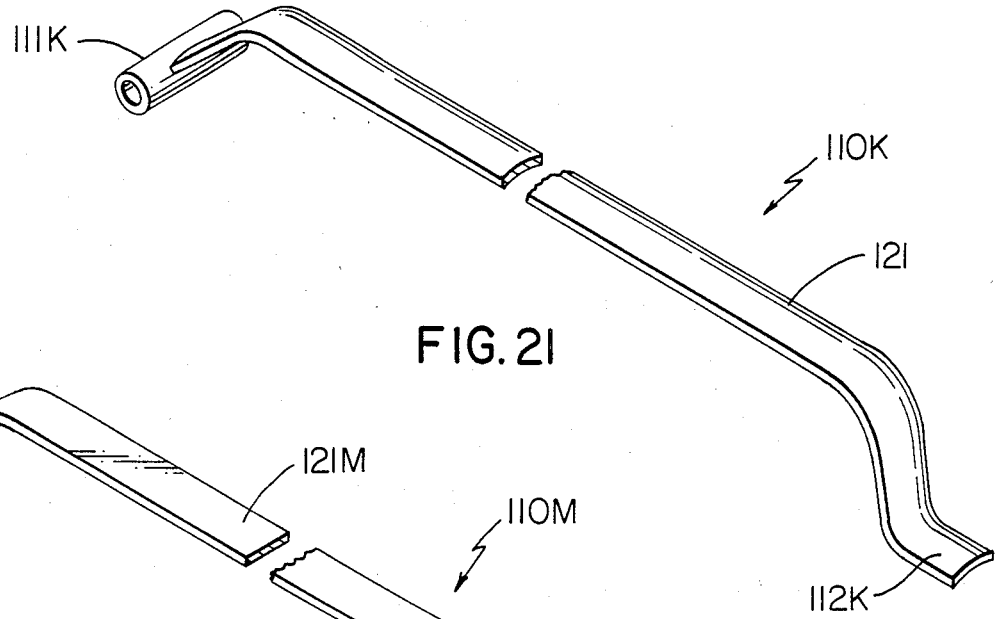
FIG. 21 is a perspective view of another reinforcing member of this invention.

For example, reference is now made to FIG. 21 wherein another reinforcing member of this invention is generally indicated by the reference numeral 110K and parts thereof similar to the reinforcing member 110 previously described are indicated by like reference numerals followed by the reference letter "K".

As illustrated in FIG. 21, the reinforcing member 110K of this invention includes the substantially tubular section 111K and the plate-like portion 112K at the other end thereof while the medial portion of the reinforcing member 110K comprises a substantially solid section 121 having an arcuate transverse cross sectional configuration as illustrated whereby the end 112K and medial section 121 have the same transverse cross-sectional configuration so that the section 121 need only be fastened to the transverse end tubular section 111K, such as by welding or the like.

If desired, the medial section 121 can be provided with a plurality of openings passing therethrough in order to mechanically interlock with the polymeric material that subsequently forms the holddown bar in combination with the reinforcing member 110K.

Figure 22:
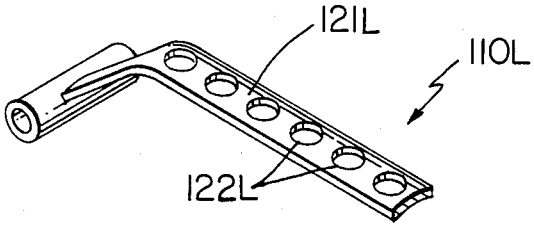
FIG. 22 is a fragmentary view similar to FIG. 21 and illustrates another reinforcing member of this invention.

For example, reference is now made to FIG. 22 wherein another reinforcing member of the invention is generally indicated by the reference numeral 110L and parts thereof similar to the reinforcing members 110 and 110K previously described are indicated by like reference numerals followed by the reference letter "L".

As illustrated in FIG. 22, it can be seen that the reinforcing member 110L is substantially identical to the reinforcing member 110K previously described except that the medial portion 121L thereof is provided with a plurality of spaced apart openings 122 passing transversely therethrough so as to provide means that will be filled with the polymeric material to mechanically interlock therewith when a holddown bar is subsequently formed with the reinforcing member 110L by having the polymeric material completely molded around the same in the manner previously described for the holddown bar 70H previously described.

While the reinforcing member 110K has the medial portion 121 thereof formed with a transverse arcuate cross-sectional configuration, it is to be understood that the same can be substantially flat if desired.

Figure 23:
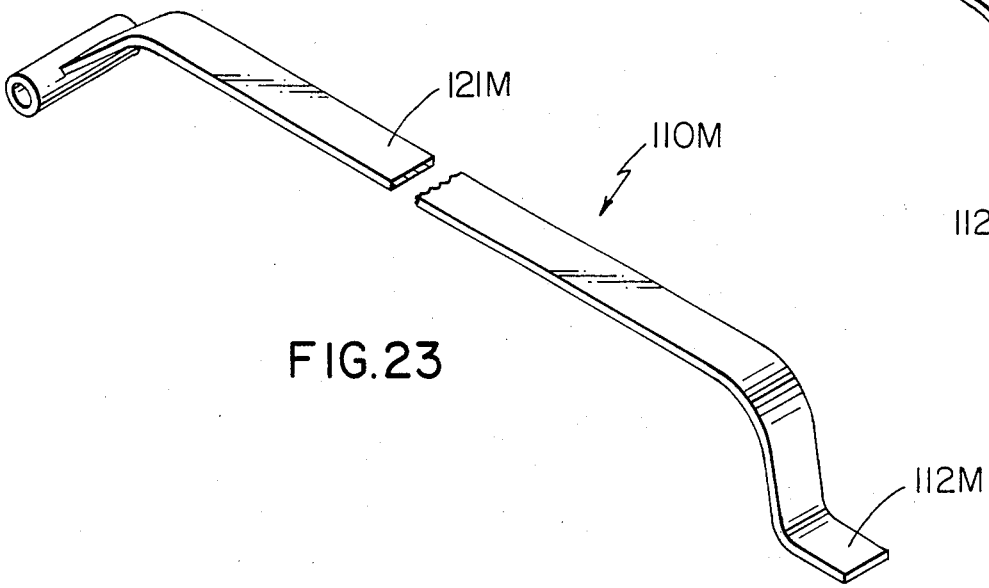
FIG. 23 is a perspective view of another reinforcing member of this invention.

For example, reference is now made to FIG. 23 wherein another reinforcing member of this invention is generally indicated by the reference numeral 110M and parts thereof similar to the reinforcing member 110K previously described are indicated by like reference numerals followed by the reference letter "M".

As illustrated in FIG. 23, it can be seen that the reinforcing member 110M of this invention is substantially the same as the reinforcing member 110K previously described except that the medial portion 121M and end portion 112M thereof are each provided with a transverse substantially flat cross-sectional configuration.

When making a holddown bar of this invention with any one of the reinforcing members 110K, 110L or 110M, the medial portion 121, 121M or 121L thereof will be disposed in the polymeric material in the area between the top of the holddown bar and the cavity thereof that carries the sealing gasket, such as by being disposed in the plane defined by the legs 114 of the reinforcing member 110 of FIG. 18 and being medial of the legs 76H thereof.

While the opposed ends 123 of the tubular portion 111 of the reinforcing member 110 previously described extends substantially to the opposed side edges 124 of the polymeric material 118 of the holddown bar 70H as illustrated in FIG. 16, it is to be understood that the opposed side edges or ends 123 of the tubular section 111 could be disposed short of the sides 124 of the polymeric material 118 so as to provide recesses therewith which can be subsequently filled with anti-friction material utilized to line the tubular section 111, if desired.

Figure 24:
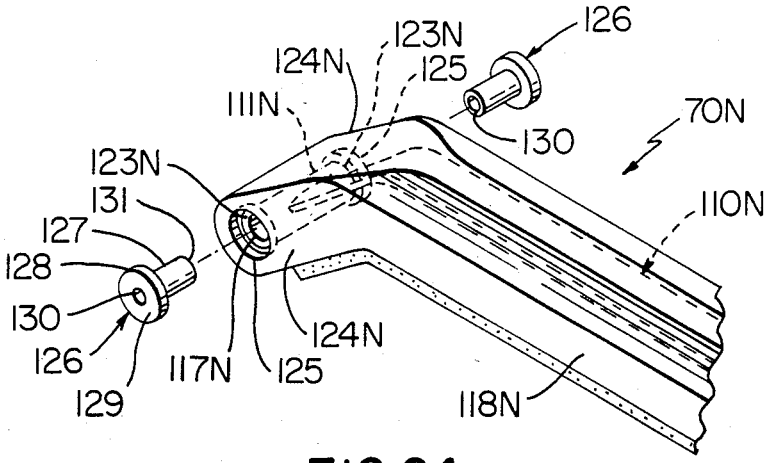
FIG. 24 is an exploded fragmentary perspective view of another holddown bar of this invention.

For example, another holddown bar of this invention is generally indicated by the reference numeral 70N in FIG. 24 and parts thereof similar to the holddown bar 70H previously described are indicated by like reference numerals followed by the reference letter "N".

As illustrated in FIG. 24, it can be seen that the opposed ends 123N of the tubular section 111N of the reinforcing member 110N of the holddown bar 70N of this invention are respectively recessed from the opposed sides 124N of the polymeric material 118N of the holddown bar 70N so that substantially annular cavities 125 are defined in the opposed sides 124N of the holddown bar 70N.

However, suitable anti-friction button-like members 126 of anti-friction material can respectively have the reduced portions 127 thereof received in the opening 117N passing through the tubular section 111N and have the disc-like portions 128 thereof fill the recesses 125 so as to have their outer surfaces 129 disposed substantially flush with the opposed sides 124N of the polymer material 118N, each button-like member 126 having an opening 130 passing therethrough which will align with the opening 130 in the other member 126 which are adapted to receive the pivot pin 42 of the hinge 43 of the railroad car 32 in the manner previously set forth.

If desired, the button-like members 126 could be secured to each other by providing suitable adhesive on the opposed ends 131 thereof and/or could otherwise be secured in the tubular section 111N, such as by adhesive or the like as desired.

Of course, a single tubular sleeve of suitable anti-friction material could be disposed in the shortened tubular section 111N and have opposed ends that respectively extend beyond the ends 123N of the tubular section 111N in such a manner that when the polymeric material of the holddown bar 70N is being disposed around the reinforcing member 110N, the polymeric material itself will fasten the tubular sleeve of anti-friction material in the opening 117N of the tubular section 111N of the reinforcing member 110N.

Therefore, it can be seen that this invention provides improved holddown bars wherein the same each comprises a substantially one-piece member formed of a relatively rigid polymeric material and having a reinforcing member therein, the reinforcing member comprising a substantially rigid member disposed in the polymeric material and having opposed ends one of which comprises the hinge part for the holddown bar and the other of which is disposed in at least part of the polymeric material that defines the latch part of the holddown bar. Such rigid member of this invention has a medial portion extending between the opposed ends thereof and is disposed in the polymeric material that defines the medial portion of the holddown bar made from the particular rigid member of this invention.

Therefore, it can be seen that this invention not only provides an improved holddown bar, but also this invention provides an improved reinforcing member for such a holddown bar or the like.

While the forms of this invention now preferred have been illustrated and described as required by the Patent Statute, it is to be understood that other forms can be utilized and still fall within the scope of the appended claims.

What is claimed is:

1. In a holddown bar for a hatch cover of a railroad car or the like, said holddown bar having opposed ends one of which has hinge means that is adapted to be pivotally mounted to said car and the other of which has latch means that is adapted to be releasably latched to said car while a medial portion thereof intermediate said opposed ends is adapted to extend across said hatch cover and carries a sealing gasket means in a channel means thereof that is adapted to engage against said hatch cover, the improvement wherein said opposed ends and medial portion of said holddown bar comprises a one-piece member formed of a relatively rigid polymeric material and having reinforcing means therein, said holddown bar having substantially flat and parallel opposed spaced apart sides throughout substantially the entire length of said opposed ends and medial portion thereof, said reinforcing means comprising a substantially rigid member disposed in said polymeric material and having opposed ends one of which comprises said hinge means for said holddown bar and the other of which is disposed in at least part of said polymeric material that defines said latch means of said holddown bar, said rigid member having a medial portion extending between said ends thereof and being disposed in said polymeric material that defines said medial portion of said holddown bar, said one opposed end of said reinforcing means comprising a tubular member having opposed ends that respectively interrupt said opposed sides of said holddown bar and are disposed substantially flush with said respective sides of said holddown bar, said medial portion and said other opposed end of said reinforcing means being disposed inboard of said opposed sides of said holddown bar and being completely covered by said polymeric material.

2. A holddown bar as set forth in claim 1 wherein said one end of said rigid member comprises a tubular section.

3. A holddown bar as set forth in claim 2 wherein said tubular section has opposed ends, said holddown bar having opposed sides defined by said polymeric material, said tubular section being disposed between said opposed sides with said opposed ends thereof being respectively adjacent said opposed sides.

4. A holddown bar as set forth in claim 1 wherein said medial portion of said rigid member has opening means passing transversely therethrough, said polymeric material filling said opening means.

5. In a holddown bar for a hatch cover of a railroad car or the like, said holddown bar having opposed ends one of which has hinge means that is adapted to be pivotally mounted to said car and the other of which has latch means that is adapted to be releasably latched to said car while a medial portion thereof intermediate said opposed ends is adapted to extend across said hatch cover and carries a sealing gasket means in a channel means thereof that is adapted to engage against said hatch cover, the improvement wherein said opposed ends and medial portion of said holddown bar comprises a one-piece member formed of a relatively rigid polymeric material and having reinforcing means therein, said holddown bar having substantially flat and parallel opposed spaced apart sides throughout substantially the entire length of said opposed ends and medial portion thereof, said reinforcing means comprising a substantially rigid member disposed in said polymeric material and having opposed ends one of which comprises said hinge means for said holddown bar and the other of which is disposed in at least part of said polymeric material that defines said latch means of said holddown bar, said rigid member having a medial portion extending between said ends thereof and being disposed in said polymeric material that defines said medial portion of said holddown bar, said one opposed end of said reinforcing means comprising a tubular member having opposed ends that respectively interrupt said opposed sides of said holddown bar and are disposed substantially flush with said respective sides of said holddown bar, said medial portion and said other opposed end of said reinforcing means being disposed inboard of said opposed sides of said holddown bar and being completely covered by said polymeric material, said medial portion of said rigid member comprising a pair of spaced apart substantially parallel beam-like parts, each beam-like part having a substantially L-shaped transverse cross-sectional configuration defined by a pair of legs thereof, said channel means having a part thereof disposed intermediate and inboard of one of said legs of each beam-like part.

6. A holddown bar as set forth in claim 1 wherein said medial portion of said rigid member has a substantially flat transverse cross-sectional configuration.

7. A holddown bar as set forth in claim 1 wherein said medial portion of said rigid member has a substantially arcuate transverse cross-sectional configuration.

* * * * *